US005154241A

United States Patent [19]

Comer et al.

[11] Patent Number: 5,154,241

[45] Date of Patent: Oct. 13, 1992

[54] SAND TRAP MAINTENANCE MACHINE

[75] Inventors: Robert C. Comer, Hopkins; David J. Scherbring, Shakopee, both of Minn.

[73] Assignee: The Toro Company, Minneapolis, Minn.

[21] Appl. No.: 642,506

[22] Filed: Jan. 17, 1991

[51] Int. Cl.[5] ..... E02F 3/76

[52] U.S. Cl. ..... 172/816; 172/811; 172/506

[58] Field of Search ..... 172/811, 816, 790, 506, 172/497, 498, 336, 810

[56] References Cited

U.S. PATENT DOCUMENTS

| | | | |
|---|---|---|---|
| 59,454 | 11/1866 | Roberts | 172/344 X |
| 373,343 | 11/1887 | D'Lamatter | 172/336 |
| 554,735 | 2/1896 | Runyon | 172/347 |
| 1,043,119 | 11/1912 | Lockett | 172/336 X |
| 1,894,516 | 1/1933 | Karstedt | 172/810 X |
| 2,228,490 | 1/1941 | Smith | 97/47 |
| 2,601,380 | 6/1952 | Flory | 172/297 X |
| 2,625,868 | 1/1953 | Coles et al. | 97/47 |
| 3,749,179 | 7/1973 | Hartman | 172/297 |
| 3,771,608 | 11/1973 | Ancherico | 172/256 X |

FOREIGN PATENT DOCUMENTS

| | | | |
|---|---|---|---|
| 897496 | 11/1953 | Fed. Rep. of Germany | 172/810 |

OTHER PUBLICATIONS

John Deere Bunker and Field Rake brochure, form No. DKE4218, copyright 1988.

Toro Sand Pro 14 brochure, form No. 89-44-T, copyright 1989.

Smithco Super Rake brochure, form No. 128820MT.

*Primary Examiner*—Randolph A. Reese

*Assistant Examiner*—Jeffrey L. Thompson

*Attorney, Agent, or Firm*—R. Lawrence Buckley

[57] ABSTRACT

A sand trap contouring attachment for a sand trap maintenance machine. A preferred attachment (12) includes a plow blade (30), a pair of blade supports (32) wherein the plow blade (30) is operatively attached to the supports (32) and wherein the supports (32) are pivotally attached to the sand trap maintenance machine (10) frame (18) at pivot points (38). Blade (30) lies at the front of machine (10), pivot point (38) lies at the rear of machine (10), and support arms (32) lie intermediate the blade (30) and pivot points (38). Control member (34) is operatively attached to the supports (32) via links (42) and (44). Control member (34) comprises an operator handle wherein the handle provides an operator gripping surface area right and left of a longitudinal center line of the machine (10). Spring means (36), (37), (39) are operatively connected to the machine (10) and the support arms (32) for biasing the supports (32) and blade (30) away from the ground. Control member (34) is adjustable to two positions. Links (40) and (44) are provided for supporting arms (32) and blade (30) in a transport mode.

13 Claims, 3 Drawing Sheets

SAND TRAP MAINTENANCE MACHINE

TECHNICAL FIELD

This invention pertains to golf course sand trap maintenance machines. Specifically, this invention pertains to plow blade attachments for sand trap maintenance machines.

BACKGROUND OF THE INVENTION

Golf course sand traps require ongoing maintenance just like other portions of a golf course. The sand within the traps is subject to compaction, erosion and infestation of unwanted vegetation, all undesirable conditions for the sand traps.

Maintaining the sand traps to alleviate the abovementioned undesirable conditions typically is very time consuming and labor intensive. For example, the maintenance procedure for a typical concave sand trap might be as follows. First, much of the sand that was along the sides of the concave trap has probably eroded to the bottom of the trap where it has become compacted and hard. Furthermore, the trap might have unwanted vegetation rooted in its sides. Maintenance requires breaking up the compacted sand on the bottom and recontouring the trap by moving the loosened sand from one part of the trap to another. The compacted sand can be broken up by manual spading, which is very difficult physical work, or by pulling, with a tractor unit, a mechanical cultivator through the trap. Any unwanted vegetation within the trap should be uprooted by spading or cultivating such vegetation at the same time. Once the compacted sand has been loosened, it must be redistributed through the sand trap so that the proper contour of the trap is restored. This too can be done manually by moving loosened sand from the bottom of the trap to the sides or other areas where sand is needed to restore the proper contour. Sand can be moved manually in a wheelbarrow, a very slow and laborious method, or by means of a tractor powered plow blade to the area of the trap that requires additional sand. Once dumped, the sand must be contoured so as to blend in with the contour of the remainder of the trap. When the recontouring is to be accomplished by means of a tractor powered plow blade, the loosened sand is typically pushed from the bottom portion of the trap outward and up the side walls, creating a pile of sand at or near the top of the sand trap sides. This sand must then be pulled back down and evenly distributed along the side walls of the trap. With the tractor powered plow blade, this is typically accomplished by the operator lifting the tractor plow blade up and over the sand pile at the top of the trap, lowering the blade so that the sand pile lies between the tractor and the blade, and backing the tractor so that the blade pulls the sand back down the side walls of the trap, distributing the sand evenly on the way down. The process of pushing loosened sand from the bottom of the trap up the side walls and then pulling it back down obviously requires that the operator lift and lower the plow blade attachment frequently. Thus, it is highly desireable to have a plow blade attachment for a sand trap maintenance machine tractor that is easy to use, requiring little physical effort to raise or lower the blade.

Prior art plow blade attachments are typically mounted so that the plow blade sits forward of the tractor. The blade is usually attached to the tractor by a pair of support arms which extend back and are pivotally connected to the frame near the front of the tractor. However, by connecting the supports to the frame at pivot points near the front of the tractor, the blade support arms are more likely to lift the front of the tractor off of the ground when the blade is pushed forward by the tractor. This is disadvantageous since the tractor is usually steered by the front wheel and since the front wheel is usually a driving wheel also.

Prior art blade attachments also usually include a spring assembly wherein the blade and blade supports are spring loaded up so as to reduce the effort required by the operator to raise or lower the blade supports and blade. Prior art blade attachments are typically raised and lowered by the operator lifting, lowering, pushing or pulling a handle bar. The handle bar is typically attached to one of the support arms, either right or left, and extends up towards the operator area. The operator must then lift or lower the assembly by applying force with one hand on the side that the handle happens to be mounted to. Since the plow blade assembly is lifted and lowered by a lift arm that is attached to only one side of the assembly, the assembly must be quite rigid, and thus, heavier and more difficult to lift so as to reduce side to side deflection of the assembly when lifting, lowering or operating it in a mid-height position. Furthermore, the lift handles are typically quite small and difficult to find and grasp when the operator is concentrating on maneuvering the machine in the trap area.

The present invention addresses the problems associated with the prior art sand trap maintenance machine blade attachments discussed above. In particular, a preferred sand trap contouring blade attachment according to the present invention accommodates ease of operation in that it incorporates a blade/support subassembly which includes a plow blade, a pair of plow blade supports pivotally attached to the rear frame portion of the sand trap maintenance machine and operatively attached to the plow blade in front of the sand trap maintenance machine, and a plow blade control member operatively attached to the blade supports and extending towards the operator position wherein the control member comprises an operator gripping surface right and left of a longitudinal center line of the machine. The sand trap contouring blade attachment also includes resilient means operatively connected to the machine and the blade/support subassembly for biasing the blade/support subassembly away from the surface to be contoured.

SUMMARY OF THE INVENTION

Accordingly, the present invention includes a sand trap contouring blade attachment for a sand trap maintenance machine.

Specifically, this invention includes a sand trap contouring blade attachment. The attachment includes a blade/support subassembly and a resilient means operatively connected to the machine and the blade/support subassembly for biasing the blade/support subassembly away from the surface to be contoured. The blade/support subassembly includes a plow blade, a pair of plow blade supports wherein the supports are pivotally attached to the maintenance machine at pivot points on the rearward portion of the machine and wherein the plow blade is operatively attached to the supports and wherein the support arms lie intermediate the pivot points and the plow blade which lies at the front of the machine. The blade/support subassembly also includes a plow blade control member wherein the member operatively engages the plow blade supports and wherein the control member extends from the blade supports towards an operator position on the machine and wherein the control member includes an operator handle wherein the handle provides operator gripping surface area right and left of a longitudinal center line of the machine. The invention also includes a plow blade attachment wherein the plow blade is capable of turning to a deflection angle of at least 1° when the plow blade encounters uneven terrain or when operator applies force to the control member at a point away from the center line.

BRIEF DESCRIPTION OF THE DRAWING

The invention will be further described with reference to the appended Drawing, wherein.

DETAILED DESCRIPTION OF A PREFERRED EMBODIMENT

Figure 1:
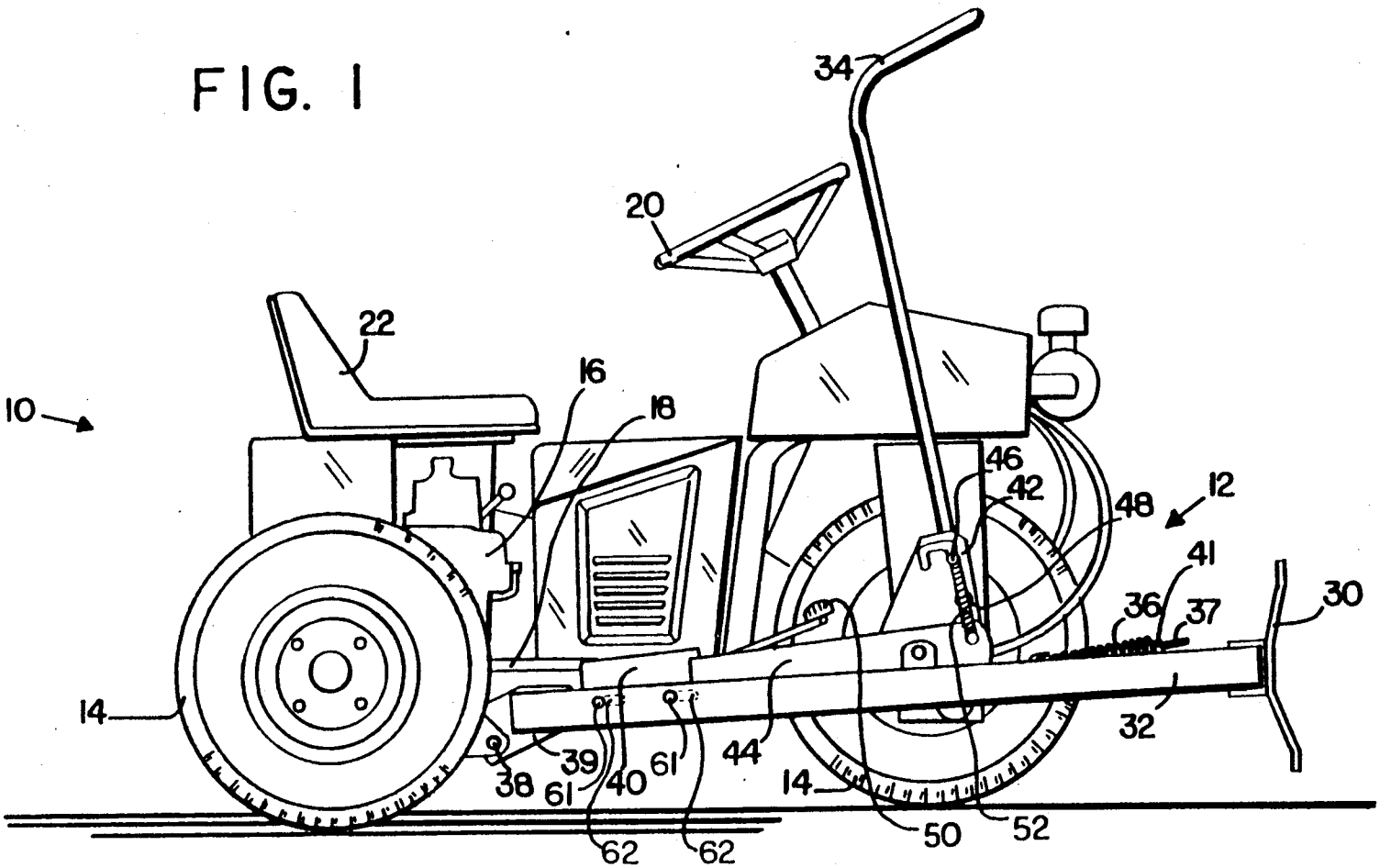
FIG. 1 is a side elevational view of a sand trap maintenance machine with a preferred sand trap contouring blade attachment in the transport or park mode.
Figure 2:
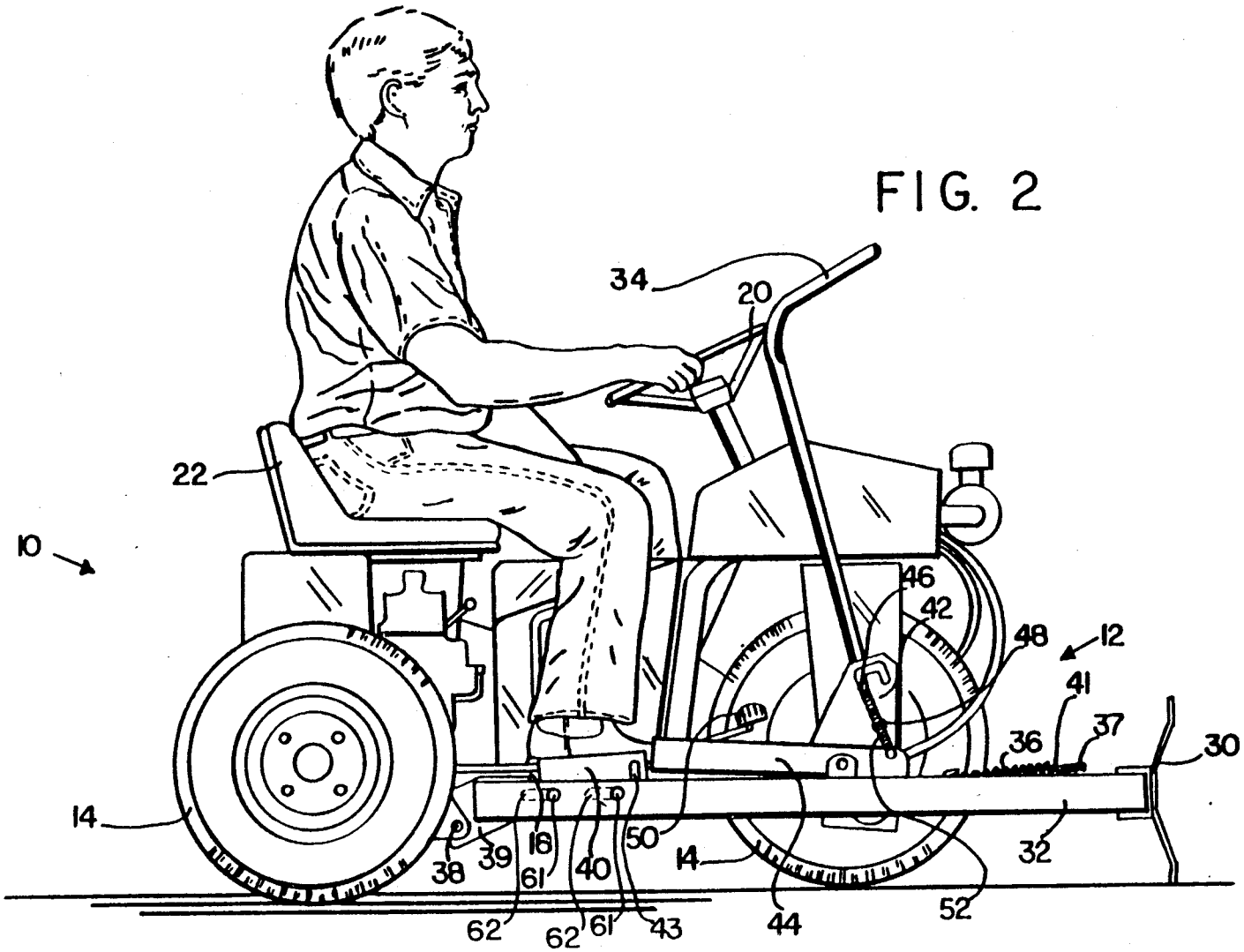
FIG. 2 is a side elevational view of a sand trap maintenance machine with a operator on board and a preferred sand trap contouring blade attachment in the operating mode.
Figure 3:
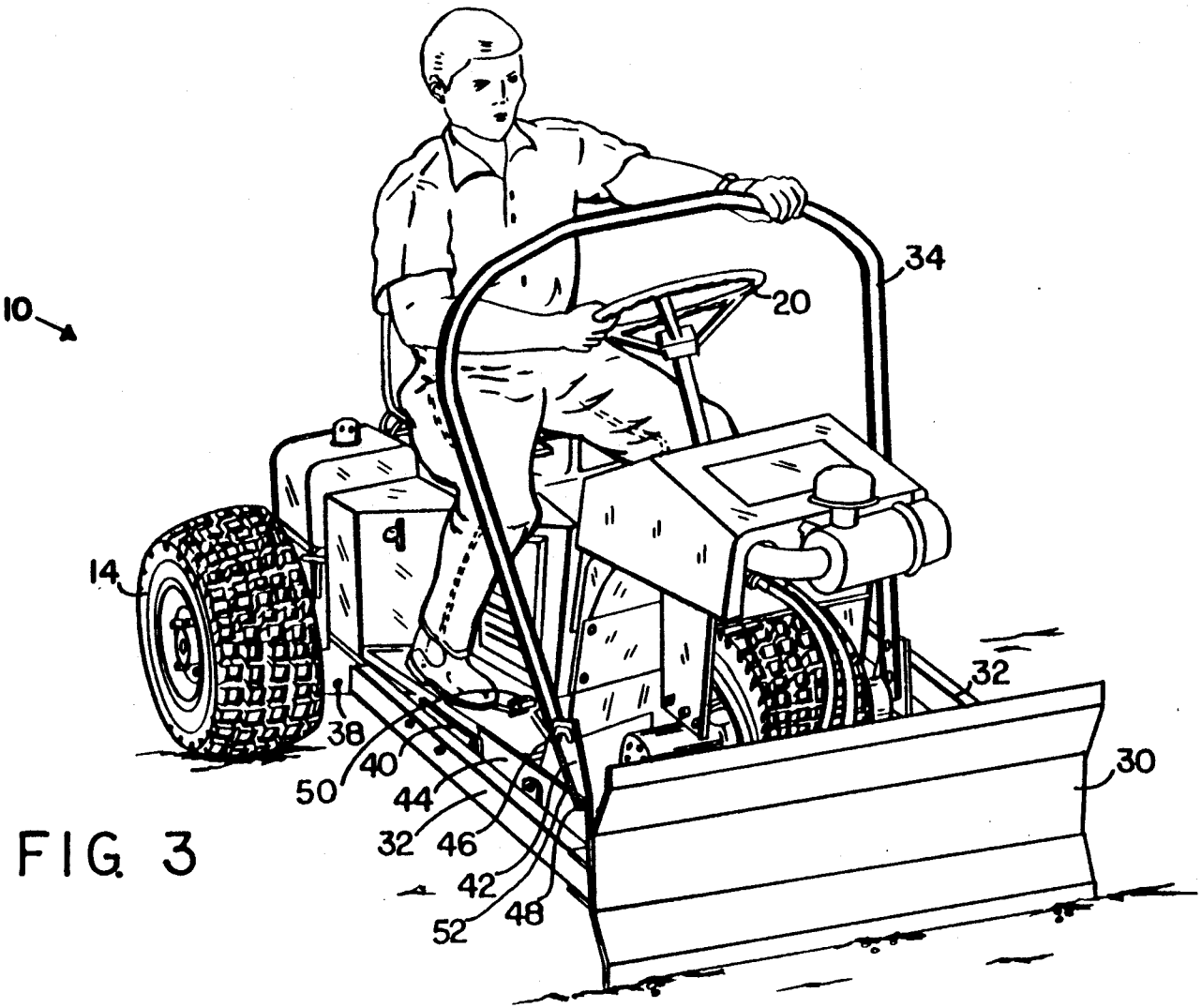
FIG. 3 is a perspective view of a sand trap maintenance machine with an operator on board in a preferred sand trap contouring blade attachment in the operating mode.

In the drawing, wherein like reference numerals designate like parts and assemblies throughout the several views, FIGS. 1 through 3 show a sand trap maintenance machine 10 with a preferred sand trap contouring blade attachment 12. The sand trap maintenance machine 10 includes three wheels 14, a prime mover 16, a frame 18, a steering wheel 20, an operator seat 22, and a speed control/brake pedal 50.

A preferred plow blade 30 is constructed of steel and is formed in a generally rectangular shape. Blade 30 is also formed so as to have a generally concave surface facing frontwardly. Blade 30 is preferably rigidly attached to a pair of support arms 32 by bolts (not shown). Blade 30 is laterally mounted onto the support arms 32, so that blade 30 is located at the front of the machine 10. Support arms 32 are constructed of steel bar or rectangular tube and extend rearwardly and longitudinally to a pair of pivot points 38. Pivot points 38 are located on and towards the rear of the maintenance machine 10. Each support arm 32 connects with its corresponding pivot point 38 by a link 39. A control member 34 is constructed of round steel tube and is configured in a general U-shape, and is installed onto machine 10 so that the bottom portion of the U extends proximate to the operator position. Control member 34 connects with support arms 32 via a pair of links 42 and 44. Control member 34 connects with support arms 32 near the front of the machine 10. Connecting link 42 incorporates a slotted area for accepting a pin 46 which is integral to control member 34. The position of control member 34 is adjustable between two positions since control member 34 and control member pin 46 are engageable in slotted link 42, wherein the slot is configured so as to provide fore and aft positions for control member 34, which pivots about a pin 48. Tension spring 52 biases control member 34 and its integral pin 46 downward so that control member 34 and pin 46 remain in fore or aft portion of slot 42 when the machine 10 is driven over rough terrain.

It is desirable to move the control member 34 from one position to another, depending on the mode of operation of the sand trap maintenance machine 10. For example, FIG. 1 depicts the sand trap maintenance machine 10 with the sand trap contouring blade attachment 12 in the transport mode. Blade 30 is supported by connecting links 40 and 44, which are interlocked and supported by frame 18. Link 40 includes a slot 43 (see FIG. 2) wherein link 40 is operatively connected to support arm 32 and wherein slot 43 is engageable on link 44, which is supported by frame member 18, so that support arm 32 and blade 30 are supported off of the ground for transporting. Link 40 is fastened to supports 32 by bolts 61. Link 40 incorporates slots 62 which permit link 40 to be moved fore and aft along bolts 61 for engaging or disengaging link 44. In the transport mode, the operator (not shown in FIG. 1) might want to have the control member 34 set to the forward position (this position shown in FIG. 1) so that the control member 34 is out of the way of the operator.

FIG. 2 depicts a sand trap maintenance machine with a sand trap contouring blade attachment 12 in the operating mode wherein the blade 30 is in contact with the ground. Blade 10 and support arms 32 are not supported by links 40 and 44 in this mode. Control member 34 is in the operating mode in FIG. 2 as control member pin 46 is positioned in the rearward slotted portion of link 42. In this mode, control member 34 is positioned closer to the operator for ease of handling.

Control member 34 is configured so as to provide a large surface area over which the operator may grasp member 34 to raise and lower blade 30. In the preferred embodiment, control member 34 is configured so as to be substantially symmetrical, providing gripping area right and left of a longitudinal center line running the length of the sand trap maintenance machine 10. Control member 34, in providing gripping surface right and left of the center line, provides ease of operation in that the operator does not have to grope for a handle with a small surface area in order to raise or lower the blade. The easily located control member 34 gripping surface permits the operator to easily locate the control member 34 and control the height of the plow blade 30, even when the operator cannot look directly at the member 34, such as when the operator is backing the machine up or looking off to another area for purposes of navigating the machine 10.

Operation of the sand trap maintenance machine 10 and the sand trap contouring blade attachment 12 is as follows. The operator steers the san trap maintenance machine 10 by manipulating the steering wheel 20. Acceleration and braking is accomplished by the operator's manipulation of foot controls 50. Traction is provided through wheels 14. The blade attachment 12 is positioned into the transport mode as shown in FIG. 1 as the machine 10 is driven to the sand trap to be worked. Blade 30 and support arms are supported by interlocking links 40 and 44 which engage frame 18 so as to position blade 30 off of the ground. Control member 34 is placed in the forward position for transport by moving member 34 so that pin 46 engages front slot of link 42. Upon arriving at the sand trap, the operator can lower blade 30 and supports 32 which pivot about pivot points 38, so that supports 32 are lowered and blade 30 touches the ground, by disengaging links 40 and 44 from frame 18. The operator also can then move control member 34 from the transport position to the rearward operating position by moving the member 34 in a rearward direction so that pin 46 engages the rear slot of link 42. The operator then maneuvers machine 10 through the sand trap so that blade 30 engages the sand in the trap, smoothing and contouring its surface as it is propelled over the surface. As the operator passes over the sand trap, he can raise or lower the blade 30 as required by pulling or pushing the control member 34. When raising the blade 30 and supports 32 by pulling the control member 34, the operator is assisted by compression spring assemblies which are mounted between supports 32 and frame 18 so as to bias blade 30, supports 32 and control member 34 upward, reducing the effort required by the operator to raise those components. The compression spring assemblies each include a compression spring 36 mounted over a threaded stud 37 restrained by a nut 41, wherein the stud 37 transmits the spring force back through link 44 to the machine frame, and wherein the spring 36 contacts a portion of the support arms 32 so as to also exert spring force on the arms 32.

Blade supports 32, plow blade 30, control member 34, and links 42, 44 and 39 are sized and constructed of material so as to permit deflection of blade 30 so that blade 30 will follow the surface to be worked, even if that surface is non-planar with the plane defined by the contact points of wheels 14. Blade 30 deflects to an angle, hereinafter referred to as the "deflection angle" as measured between the bottom edge of the blade 30 and a plane defined by the points where the wheels 14 contact the ground, when it encounters uneven terrain or when the operator applies force to the control member 34 on either side of a longitudinal center line running the length of the machine 10. For example, in one embodiment of the present invention, the operator's application of a 60 pound force differential applied side to side of the longitudinal center line created a deflection angle of 2.1 degrees. FIG. 3 shows blade 30 deflecting and following a surface that is non-planar with the plane defined by the three contact points of the wheels 14. In FIG. 3, the operator is also applying a force to control member 34 at a point off of a center line running longitudinally from the front to the back of the machine 10, which aids in the deflection of blade 30 at some deflection angle so that blade 30 will follow the uneven surface shown.

It is typical for the operator to raise and lower the blade attachment 12 frequently while contouring a sand trap. Often, the operator must do this while unable to look at the blade attachment 12 and its control member 34, such as when the operator is backing the machine or looking off to another area for purposes of navigating the machine. The control member 34 provides a gripping surface that extends throughout a large portion of the operator area so that the operator can easily locate and grasp the control member.

A preferred embodiment of the invention is described above. Those skilled in the art will recognize that many embodiments are possible within the scope of the invention. Variations and modifications of the various parte and assemblies can certainly be made and still fall within the scope of the invention. Thus, the invention is limited only to the apparatus, and method recited in the following claims, and equivalents thereof.

We claim:

1. In a golf course sand trap maintenance machine, a sand trap contouring blade attachment comprising:

(a) a blade/support subassembly comprising:
  (i) a plow blade;
  (ii) a pair of plow blade supports operatively connected to said plow blade, wherein said plow blade supports are pivotally attached to said maintenance machine at pivot points on said machine and wherein said plow blade supports lie intermediate said pivot points and said plow blade, said plow blade located in front of said machine and said pivot points located near the rear of said machine; and
  (iii) a plow blade control member wherein said member operatively engages said plow blade supports and wherein said control member extends from said blade supports towards an operator position on said machine and wherein said control member comprises an operator handle wherein said handle provides an operator gripping surface area right and left of a longitudinal center line of said machine; and (b) resilient means operatively connected to said machine and said blade/support subassembly for biasing said blade/support subassembly away from a surface to be contoured.

2. The sand trap contouring blade attachment of claim 1, wherein said plow blade comprises a generally rectangular sheet metal plate fixedly attached to said plow blade supports wherein said plate is non-planar.

3. The sand trap contouring blade attachment of claim 1, wherein said resilient means comprises a pair of compression springs operatively connected between said plow blade supports and said machine.

4. The sand trap contouring blade attachment of claim 1, wherein said plow blade control member comprises a metal tube configured so as to be substantially symmetrical about said center line.

5. The sand trap contouring blade attachment of claim 1, wherein said blade attachment further comprises a latch wherein said latch is selectively engageable between said blade/support subassembly and said machine so as to provide an optional elevated transport position for said blade attachment.

6. The sand trap contouring blade attachment of claim 1, wherein said control member is operatively attached to said plow blade supports so as to provide two or more operating positions for said control member, said first position being proximate to an operator position and said second position being distal from said operator position.

7. A sand trap maintenance machine comprising:

(a) a frame;
(b) a prime mover;
(c) three wheels wherein one of said wheels is operatively coupled to said prime mover so as to provide motive force to said machine;
(d) steering, braking and speed control means;
(e) means for supporting an operator on said machine;
(f) a blade/support subassembly comprising:
  (i) a plow blade;
  (ii) a pair of plow blade supports operatively connected to said plow blade, wherein said plow blade supports are pivotally attached to said maintenance machine at pivot points on said machine and wherein said plow blade supports lie intermediate said pivot points and said plow blade, said plow blade located in front of said machine and said pivot points located near the rear of said machine; and (iii) a plow blade control member wherein said member operatively engages said plow blade supports and wherein said control member extends from said blade supports towards an operator position on said machine and wherein said control member comprises an operator handle wherein said handle provides an operator gripping surface area right and left of a longitudinal center line of said machine; and (g) resilient means operatively connected to said machine and said blade/support subassembly for biasing said blade/support subassembly away from a surface to be contoured.

8. The sand trap maintenance machine of claim 7, wherein said plow blade comprises a generally rectangular sheet metal plate fixedly attached to said plow blade supports wherein said plate is non-planar.

9. The sand trap maintenance machine of claim 7, wherein said resilient means comprises a pair of compression springs operatively connected between said plow blade supports and said machine.

10. The sand trap maintenance machine of claim 7, wherein said plow blade control member comprises a metal tube configured so as to be substantially symmetrical about said center line.

11. The sand trap maintenance machine of claim 7, wherein said blade attachment further comprises a latch wherein said latch is selectively engageable between said blade/support subassembly and said machine so as to provide an optional elevated transport position for said blade attachment.

12. The sand trap maintenance machine of claim 7, wherein said control member is operatively attached to said plow blade supports so as to provide two or more operating positions for said control member, said first position being proximate to an operator position and said second position being distal from said operator position.

13. In a golf course sand trap maintenance machine, a sand trap contouring blade attachment comprising:

(a) a blade/support subassembly comprising:

(i) a plow blade;

(ii) a pair of plow blade supports operatively connected to said plow blade. wherein said plow blade supports are pivotally attached to said maintenance machine at pivot points on said machine and wherein said plow blade supports lie intermediate said pivot points and said plow blade, said plow blade located in front of said machine and said pivot points located near the rear of said machine: and (iii) a plow blade control member wherein said member operatively engages said plow blade supports and wherein said control member extends from said blade supports towards an operator position on said machine and wherein said control member comprises an operator handle wherein said handle provides an operator gripping surface area right and left of a longitudinal center line of said machine; and (b) resilient means operatively connected to said machine and said blade/support subassembly for biasing said blade/support subassembly away from a surface to be contoured;

wherein said plow blade is capable of turning to a deflection angle of at least 1° when said plow blade encounters uneven terrain or when operator applies force to said control member at a point away from said center line.

* * * * *